United States Patent [19]

Kotur

[11] Patent Number: 4,893,954

[45] Date of Patent: Jan. 16, 1990

[54] REMOVABLE KEYBOARD COVER FOR OFFICE MACHINES

[76] Inventor: Donald R. Kotur, 839 Castlebar Ct., Ballwin, 63021

[21] Appl. No.: 49,095

[22] Filed: May 13, 1987

[51] Int. Cl.[4] ..... B41J 11/62

[52] U.S. Cl. ..... 400/714; 248/442.2

[58] Field of Search ..... 400/713, 714, 691, 496, 400/715; 248/442.2, 451; 235/145 R; 206/305, 314

[56] References Cited

U.S. PATENT DOCUMENTS

| | | | |
|---|---|---|---|
| 4,481,556 | 11/1984 | Berke et al. | 400/715 |
| 4,482,063 | 11/1984 | Berke et al. | 400/715 |
| 4,547,311 | 10/1985 | Sako et al. | 252/502 |

OTHER PUBLICATIONS

Kling, C. C. "Plastic Keyboard Translator", IBM Technical Disclosure Bulletin, vol. 4, No. 12, May 1962, pp. 3–4.

*Primary Examiner*—Paul T. Sewell

*Attorney, Agent, or Firm*—Rogers, Howell & Haferkamp

[57] ABSTRACT

A removable cover for keyboards for word processors, computers, typewriters and calculators has a lower surface and upper surface which are substantially flat. The lower surface has a plurality of recesses, shaped to conform to the upper portions of the keys. The recesses engage the upper key portions to prevent sliding of the cover along the keys. The cover can be flexible, such as of leather. The cover can be grasped by the fingers of a hand and easily removed from the keyboard to be stored or placed atop a desk. The periphery of the cover is of reduced thickness for neater appearance. The recesses can be of varying depth from the front to the rear of the recess, or can be of uniform depth, depending upon the slant of the keyboard and the relative height of the keys to one another. The cover can also be used as a mouse pad or can be written upon or have objects placed thereon when placed on a desk. The sheet can be treated with antistatic material, and the lower surface treated with a gripping material to improve engagement with the keys.

6 Claims, 1 Drawing Sheet

10
12
14
16
18
20
22
24
26
28
30
34
52
54
13
2
2

10
12
14
18
19
34
36
38
52
54
56

10
12
26
30
36
38
40
42
44
46
64
24
4
4

10
12
26
34
36
38
56
64

10'
12'
36'
70
72
74
78
6
6

10'
12'
34'
36'
70
72
74
78

REMOVABLE KEYBOARD COVER FOR OFFICE MACHINES

BACKGROUND AND SUMMARY OF THE INVENTION

This invention relates to covers for keyboards for word processors, computers, calculators and typewriters which are placed over the keyboard keys of such machines when the machine is not to be operated, and which are removed when an operator is to press the keys to operate the machine. Heretofore there have been removable covers for typing and computing machines to protect the keys from dust, debris and liquid. Some of these covers have been rigid, with exterior flanges depending downwardly to fit around the perimeter keys. Others are mounted as on rollers above the typewriter and unrolled to extend over the keys and typewriter, with the cover's lower end secured to the front of the typewriter. Still other removable covers are box-like with side walls that fit about the exterior of the keyboard console and with a top wall which fits well above the keys. These various prior art covers can be removed to fully expose the keys. Such covers are too large and bulky, not sufficiently flexible, and use excessive material.

Other prior art covers are of flexible material with front, rear and side walls that fit about the walls of the console to hold the cover in place. The sides of such covers are usually separate from the top, front and rear. The separate pieces are secured together such as by sewing.

The present invention improves over the prior art. The invention is compact for economy in manufacturing and ease in using and in packing, shipping and storing. Its flexibility makes it easier to use and store. The invention uses a minimum amount of material to accomplish the results.

The novel removable cover comprises a sheet with upper and lower surfaces. The lower surface has a plurality of recesses shaped to receive at least an upper portion of the keys. For slanted keyboards, the depth of the recesses varies from front to rear to accommodate the slope and shape of the keys. For a keyboard wherein the keys rise at a uniform height above the keyboard panel, the recesses can be of uniform depth. The cover can be of flexible material such as leather.

The recess surfaces contact the keys. This contact resists sliding movement of the cover from the keys. The cover can be coated with an anti-static material as well and with a material to increase the frictional engagement of the cover with the keys.

Because of the multiple points of contact offered by the recesses, it is not necessary to have depending flanges about the periphery of the sheet for fitting around the keys. This means less material is needed to cover the keys. Without depending flanges or walls, the cover can be used on a greater variety of consoles, provided the layout for the keys is the same, without interference from the flanges engaging parts of the console or keyboard to prevent covering of the keys.

The novel cover can have an upper and a lower surface that are substantially flat to provide the advantage of being laid on a desk top. Writing pads can be placed on the flat upper surface and written upon without interference. Books, magazines, written documents and the like can also be placed upon it. The cover can further function as a mouse pad when using a mouse controlled cursor.

When placed in position on the keyboard during a time when the machine is not to be operated, the novel cover blocks dirt, dust, liquid as well as paperclips, pencil leads, bits of paper, and debris from contacting the keys and the keyboard, and from getting wedged or caught in spaces between the keys and the keyboard panel.

The novel cover is light weight. When it is time to use the machine, the cover can be easily grasped by the fingers and removed from the keyboard and stored or placed atop a desk so that the operator can press the keys and operate the machine.

DESCRIPTION AND OPERATION OF THE PREFERRED EMBODIMENT

Figure 1:
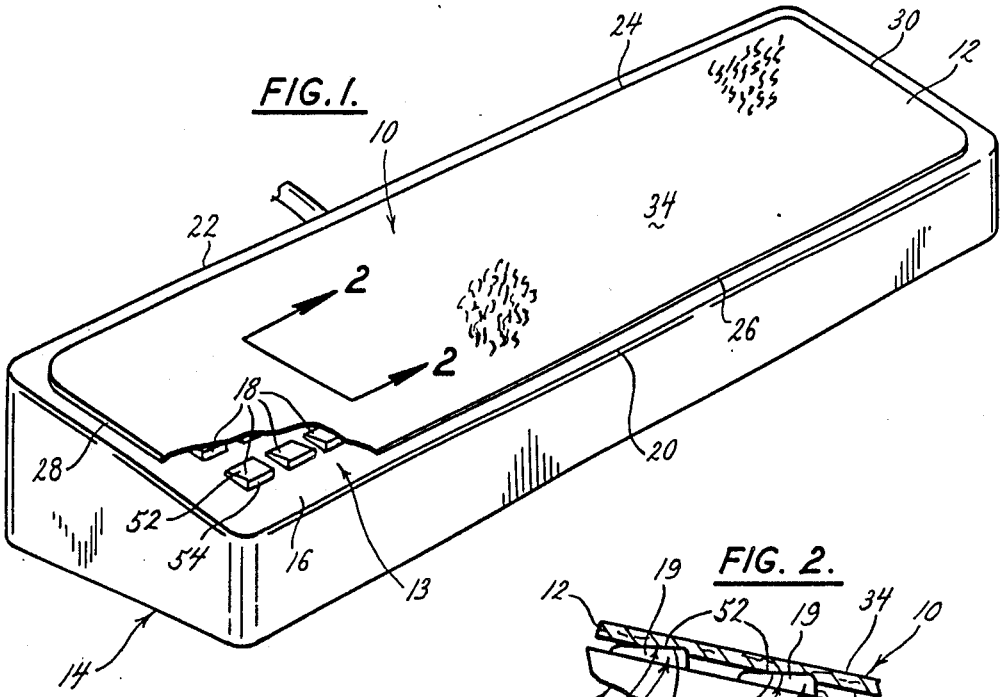
FIG. 1 shows the novel cover placed above the keys of a keyboard located at the top of a console.

Referring to the drawings, the novel removable cover 10 which comprises a planar sheet 12, is shown mounted to the top of a keyboard 13 of a console 14. In the illustration, the console 14 is of a type for a computer, word processor, typewriter, or calculator. The keyboard 13 has an upper panel 16, which is shown in this instance as flat, and a plurality of keys 18. The keys 18 have upper portions 19. The panel 16 has front and rear edges 20 and 22, while the sheet 12 likewise has front and rear edges 24 and 26, respectively. The sheet 12 has side edges 28 and 30.

Figure 2:
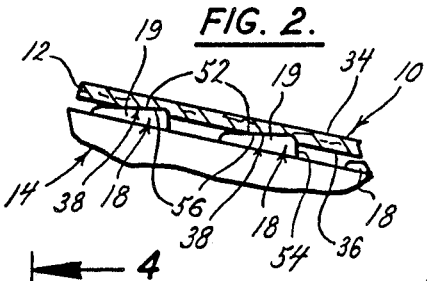
FIG. 2 is a section taken on the line 2—2 of FIG. 1 showing parts of the cover, the keys and keyboard.
Figure 3:
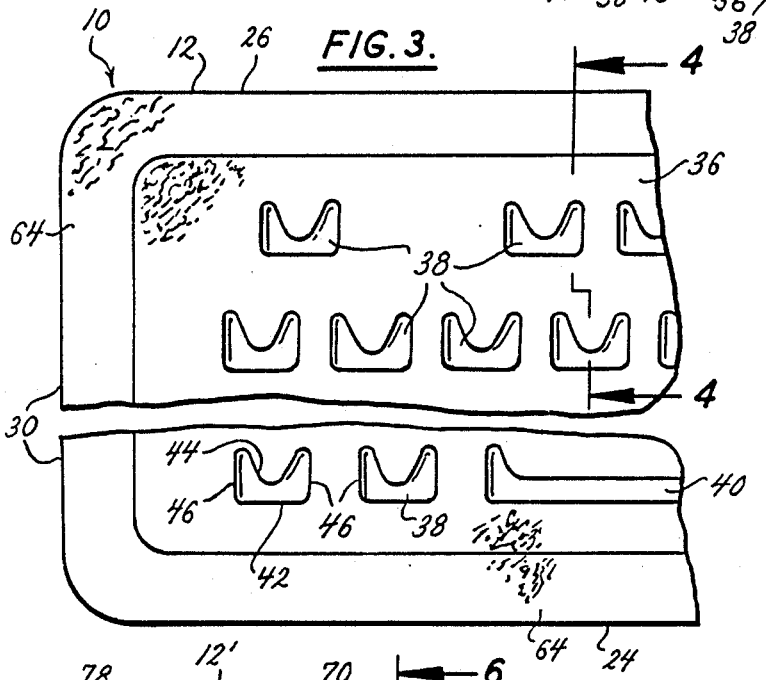
FIG. 3 is a plan view of the lower surface of the cover, partially broken showing recesses for receiving keys and the spacebar.
Figure 4:
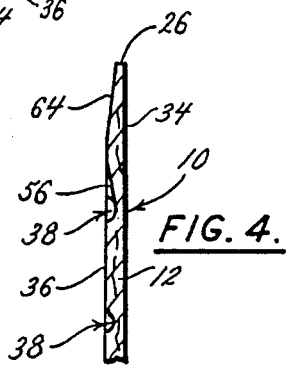
FIG. 4 is a section of the cover taken on the line 4—4 of FIG. 3.

The sheet 12 has an upper surface 34 and as seen in FIGS. 2–4, a lower surface 36. The lower sheet surface 36 has a plurality of recesses 38 for reception of upper portions 19 of keys 18.

The recesses 38 are shown to be of a substantially identical size, but there can also be recesses of different sizes such as shown for the recess 40 for a space bar. The recesses can be sized to conform to the shape of the upper portion of the key which it is to receive. Each recess 38 has front and rear edges 42 and 44, respectively, such as shown for one recess 38 in FIG. 3. Each recess 38 likewise has side edges 46. Referring to FIG. 2, it can be seen that the keys 18 have top surfaces 52 as well as side surfaces 54.

As shown for one recess in FIGS. 3 and 4, the recesses 38 have surfaces 56 which contact the key top surface 52 and the side surfaces 54. The frictional engagement of the recessed surfaces 56 against the top and side surfaces 52 and 54 resists sliding movement of the cover 10 away from the keys 18 and the keyboard 13.

As shown for the keyboard arrangement in FIGS. 1–4, with a panel 16 which slants from front to rear, and with keys 18 placed at staggered heights as shown in FIGS. 1 and 2, the recesses 38 do not need to completely receive the top key surfaces 52. Accordingly, the recesses 38 in FIGS. 1–4 do not have surface areas commensurate with the areas of the top key surfaces 52. Further, as seen in FIG. 3, the rear edge 44 of the recesses 38 can be arcuate. In FIG. 3, the side edges 46 of the recesses 38 extend rearwardly so that the recessed surface 56 will engage the side wall surfaces 54 therealong.

The perimeter of the lower surface 36 can be reduced in thickness at 64 to present a neater appearance about the sheet edges 24, 26, 28 and 30. The modification of FIGS. 5 and 6 has a cover 10′ with a sheet 12′ having a lower surface 36′ and a plurality of recesses 70. The cover 10′ is for use with a keyboard having the tops of the keys in plane with each other so that side surfaces such as 54 are substantially uniformly exposed all about the keys. The recesses 70 have sides 72 extending about the perimeter of the recess 70 as well as upper surface components 74, for engaging the top key surface. The sheet 12′ likewise can have a section 78 of reduced thickness extending about the periphery of the sheet 12′.

Figure 5:
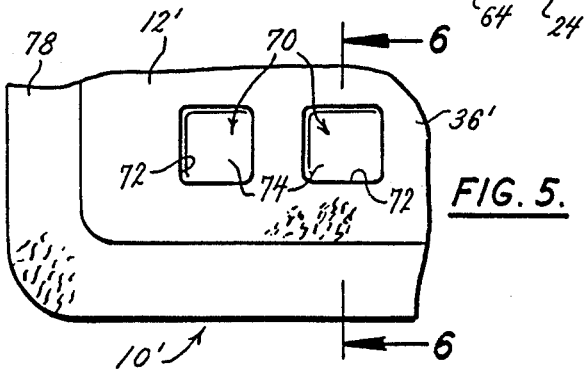
FIG. 5 is a partially broken plan view of the lower surface of a modification of the invention showing recesses having uniform depth.
Figure 6:
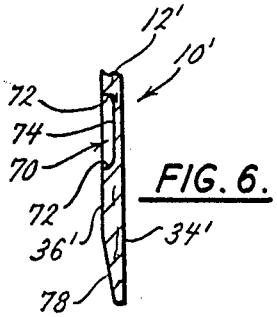
FIG. 6 is a section taken on the line 6—6 of FIG. 5.

The surfaces 72 and 74 of sheet 12′ likewise act to frictionally engage the surfaces of the keys to resist sliding movement of the sheet 12′ and cover 10′ away from the keys and the keyboard. With cover 10′, a major number of the recesses can have the uniform depth such as illustrated in FIGS. 5 and 6. If desired, a selected number of the recesses can be of non-uniform depth for conforming with the shape of certain keys.

In the position shown in FIG. 1, the keys are not to be operated, and the cover 10 blocks dirt, dust, liquid as well as paperclips, pencil leads, bits of paper and debris from contacting the keys and the keyboard, and from getting wedged or caught between the keys and keyboard panel. Both covers 10 and 10′ are lightweight. When it is desired to put the machine in use, the cover 10 or 10′ can be grasped by the fingers of a hand and easily be removed from a position covering the keyboard, and stored or placed atop a desk as hereinafter explained. The operator can then press the keys and operate the machine.

The lower sheet surfaces 36 and 36′ can be treated with an anti-static substance such as a solvent loaded with carbon black to militate against static buildup. Both the surfaces 36 and 36′ and recesses 38 and 70 can be coated with a gripping surface having a higher coefficient of friction than leather, such as of latex rubber, to increase the frictional resistance of movement between the sheets 12 and 12′ and the keys and keyboard. The latex also prevents the nap from falling off on to the keys or keyboard. The upper surfaces 34 and 34′ can be substantially flat, and the lower surfaces 36 and 36′ can also be substantially flat except for the area taken up by the recesses and by the reduced perimeter 64 and 64′. This substantially flat shape allows the covers 10 and 10′ to be placed on the substantially flat surface of a desk to serve as a mouse pad, to permit a writing pad to be placed atop the cover 10 or 10′ and written upon, or to otherwise place books, magazines or other documents thereon for stable support.

The sheets 12 and 12′ are preferably of flexible material such as soft leather. The covers 10 and 10′ and sheets 36 and 36′ can have upper surfaces 34 and 34′ that are of tanned leather or otherwise of a finished appearance. The covers 10 and 10′ can likewise be used with keyboard panels that are of other shapes, such as curved.

There are various changes and modifications which may be made to the invention as would be apparent to those skilled in the art. However, these changes or modifications are included in the teaching of the disclosure, and it is intended that the invention be limited only by the scope of the claims appended hereto.

What I claim is:

1. A removable protective cover for the keys of a keyboard for computers, typewriters, word processors, and calculators with the keys having top portions, the said cover comprising:
   (a) a thin sheet of flexible material for placing over the keyboard keys;
   (b) the sheet having an upper surface and a lower surface, and
   (c) the lower sheet surface having a plurality of shallow recesses shaped for receiving and engaging the top portions of the keys, the recesses being at least substantially contained within the thickness of the sheet and having surfaces so that contact between the keys and the surfaces of the recesses resists sliding movement of the sheet away from the keys, and wherein the cover must be removed from the keyboard so that an operator can press the keys to operate the computer, typewriter, word processor or calculator, the upper surface of the cover being substantially flat and of sufficient friction so that the cover may be placed on the surface of a desk and used for a mouse pad.

2. The cover of claim 1 wherein the lower surface is coated with a substance to increase frictional contact with the keys, the coating being sufficient to relieve the likelihood of slipping of the cover from the keys but not to prevent removal of the cover.

3. The cover of claim 1 wherein the keyboard has a front and rear: the cover having a front which corresponds to the front of the keyboard, and a rear which corresponds to the rear of the keyboard and wherein the depth of the recesses is greater in the part of the recesses toward the front of the cover, and lesser in the part of the recesses toward the rear of the cover.

4. The cover of claim 1 wherein at least a plurality of the recesses are of uniform depth from the front to the rear of the recesses.

5. The cover of claim 1 wherein the keys have top surfaces and side surfaces, and the surfaces of the recesses contact the top surfaces and the side surfaces of the keys.

6. The cover of claim 1 wherein the sheet is treated with an anti-static material, and the lower surface is coated with a substance to increase frictional contact with the keys, sufficiently to aid in supporting the sheet on the keys without restricting the intentional removal thereof.

* * * * *